United States Patent [19]

Facchinelli

[11] 4,195,735

[45] Apr. 1, 1980

[54] REBOUND SORTING DEVICE GENERALLY FOR TROUT AND FISH EGGS

[76] Inventor: Adriano Facchinelli, Ceole di Riva del Garda (Trento), Italy

[21] Appl. No.: 925,689

[22] Filed: Jul. 18, 1978

[51] Int. Cl.[2] ..... B07C 5/00

[52] U.S. Cl. ..... 209/510; 209/551; 209/640; 209/905; 209/906

[58] Field of Search ..... 209/510, 551, 637, 640, 209/906, 905, 932

[56] References Cited

U.S. PATENT DOCUMENTS

| | | | |
|---|---|---|---|
| 2,151,737 | 3/1939 | Bryan | 209/640 |
| 2,607,482 | 8/1952 | Weisz | 209/640 |
| 2,666,524 | 1/1954 | Payne | 209/640 |
| 3,411,626 | 11/1968 | Kreamer | 209/640 |
| 3,587,857 | 6/1971 | Reznik | 209/640 |

FOREIGN PATENT DOCUMENTS

| | | | |
|---|---|---|---|
| 872685 | 4/1953 | Fed. Rep. of Germany | 209/637 |

*Primary Examiner*—Allen N. Knowles
*Attorney, Agent, or Firm*—Haseltine, Lake & Waters

[57] ABSTRACT

A sorting device, particularly for trout and fish eggs which is of the type having an inclined wall against which the eggs are launched and caused to rebound a distance apart depending on the resilience thereof. Collecting means are provided for receiving the eggs according to their different trajectories. The device comprises a tank for receiving eggs and water having a rotating drum associated therewith having a plurality of cups on the outer surface thereof. Each cup is adapted to receive one egg therein and the cups are arranged in parallel transverse rows. The bottom of the cups is perforated so as to permit the water to be discharged therefrom. A fan is provided in order to dry the eggs in the cups through the perforated bottom thereof and a pneumatic launching device serves to launch the eggs against the inclined wall.

6 Claims, 2 Drawing Figures

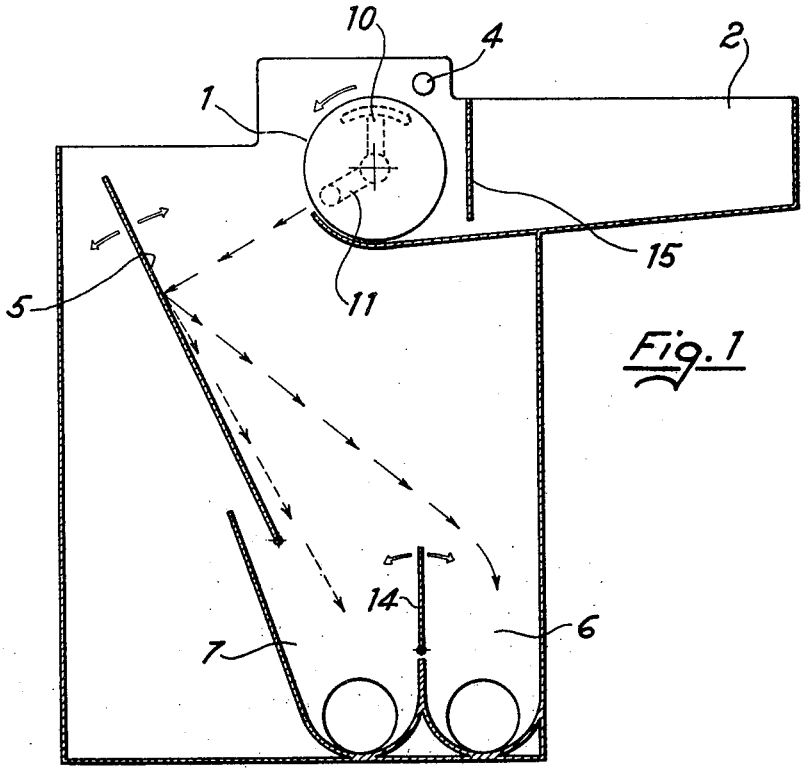
Fig. 1
Fig. 2
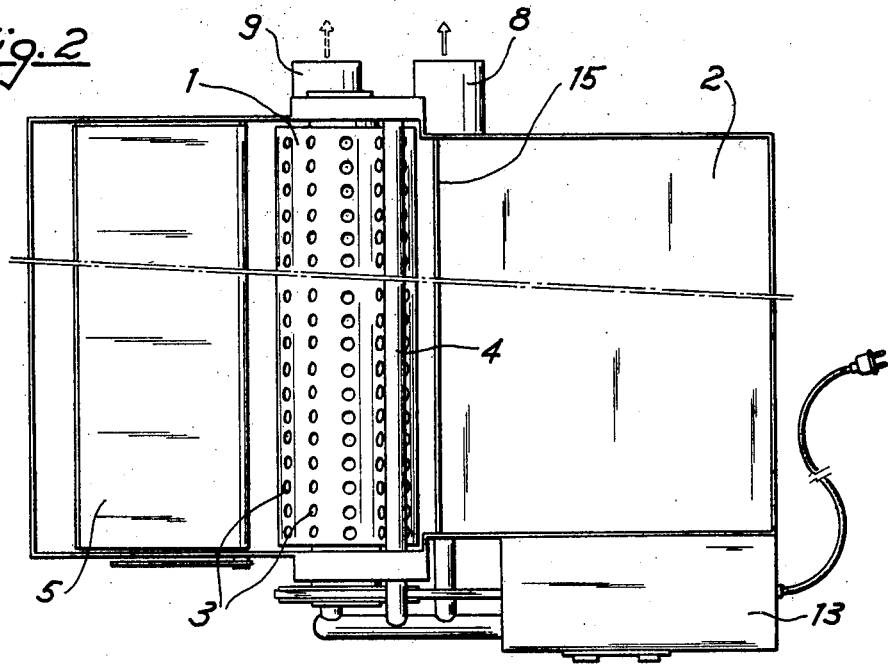

REBOUND SORTING DEVICE GENERALLY FOR TROUT AND FISH EGGS

This invention relates to a sorting or selecting device generally for trout and fish eggs, characterized by using different rebound capabilities of said eggs, such capabilities prevailingly depending on the vitality and hence on the quality of the egg.

The sorting or selecting device comprises means for arranging the eggs in a suitable aligned and spaced apart relationship on a rotary drum, wherein the eggs are suction dried and caused to advance to the zone of the rebound wall, against which wall they are launched to fall down by gravity due to the differentiated rebound thereof into distinct separating picking means to be discharged therefrom outside the sorting or selecting device.

At present, a photoelectric cell sorting or selecting device is known which operates on the ground of the different colouring distinguishing vital eggs from those deprived of life. However, this sorting or selecting device is operatively very slow and can give only but a very low ouput.

It is the object of the present invention to provide an apparatus capable of a very high output, or capable of sorting or selecting in the same time unit a much larger amount of eggs. Thus, the apparatus according to the invention exhibits an output capability of about ten times larger than that hitherto obtained.

It is a further object of the present invention to provide an apparatus for counting with a good approximation the number of sorted or selected eggs.

According to the invention, the apparatus comprises a more or less tank or basin, into which the eggs are introduced together with water, this tank or basin being associated with a rotary drum carrying on the outer shell or surface an overall assembly of cups having a perforated or foraminous bottom and designed for separately accomodating a single egg for each cup. On rotating, the foraminous or perforated drum removes the eggs away from water, which eggs, after being dried by ventilation, are row by row aligned in front of the rebound wall and then pneumatically launched still row by row against said wall, allowing the occurrence of differentiated rebound determining the selection or sorting of the eggs. The latter will fall down in distinct picking means, from which they are carried to the outside.

In the figures of the accompanying drawings, the apparatus according to the invention has been schematically shown by mere way of unrestrictive example as embodied in a preferred embodiment thereof. Of course, any other embodiment following the same inventive concepts or embodying, even in a different combination, the features of the present invention, would be within the scope of the invention and accordingly within the covering field of the related patent.

In the drawings:

FIG. 1 is a cross-sectional view showing in a largely reduced scale the diagram of the sorting or selecting device;

FIG. 2 is a plan view of the sorting or selecting device shown in FIG. 1;

Figure 3:
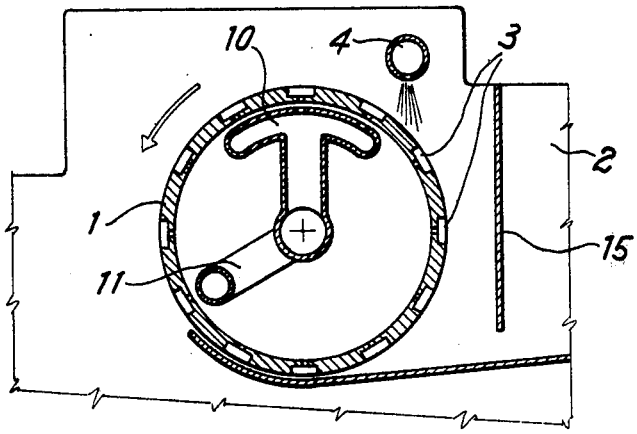
FIG. 3 is a detailed and enlarged view with respect to FIGS. 1 and 2 showing the egg carrying drum or cylinder in a cross-sectional view.
Figure 4:
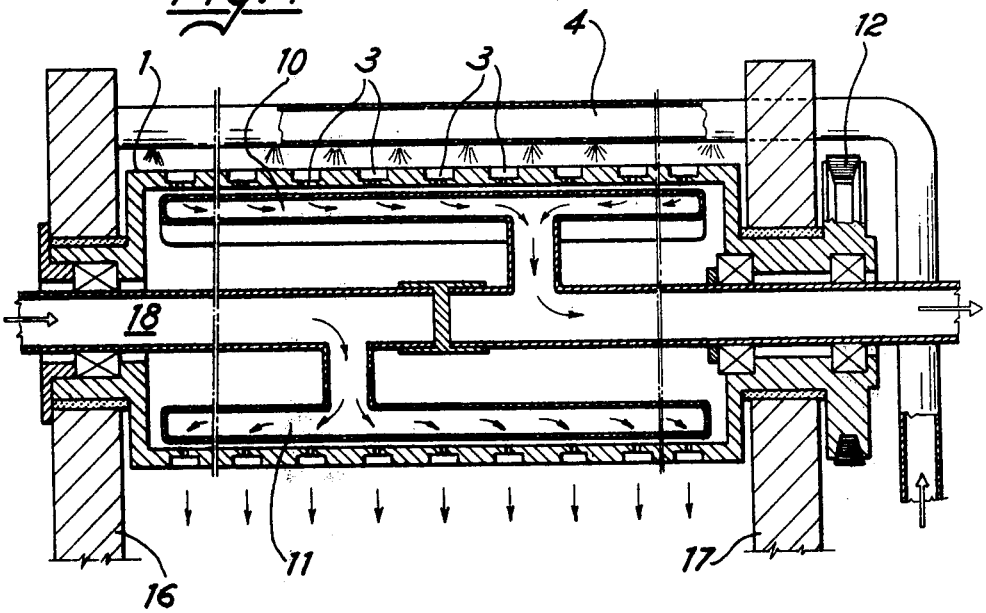
FIG. 4 is a longitudinal cross-sectional view showing the carrying drum and associated devices.
Figure 5:
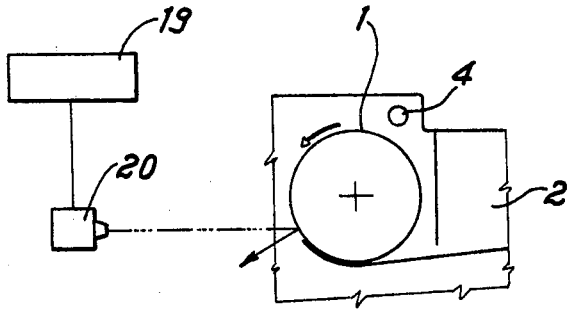
FIG. 5 is a diagram relating to the numerical count of the eggs.

The basic element of the sorting or selecting device comprises a drum or cylinder 1 which has on its outer shell or surface a plurality of concaved cups with a forminous or perforated bottom, the cups being aligned in parallel rows.

In upward direction on the side facing a basin or tank 2, into which mixed water and eggs are introduced, as rotably driven said drum 1 will crowd the well distributed eggs filling up the cups 3. Possible eggs that should remain sticked to the drum outside of cups 3 would be washed away by a rainer 4 and brought back to the mass.

On rotation, said drum 1 upward carries the eggs resting thereon by entering said cups, dries said eggs by air suction through the bottom holes of the cups, and completes the transfer of the eggs by carrying the latter to a position in front of rebound wall 5, against which such eggs are launched by blowing to rebound according to a different pattern for a selection or sorting to fall down separately and in accordance with the quality thereof into respective compartments 6 and 7. The eggs of the best quality, or the most rebounding eggs as provided with a higher elasticity, will fall down into compartment 6. Said compartments 6 and 7 are provided with conduits 8 and 9, respectively, the conduits having a slanting bottom and with running rivulet water, separately discharging the selected or sorted eggs to the outside.

Internally of the drum and at the topmost section, a suction line 10 is provided, externally terminating in a suction fan or impeller (not shown).

Still internally of the drum and at the section facing said rebound wall 5, a blowing line 11 is provided, externally terminating in a blowing fan or impeller (not shown).

Through a belt 12, said drum 1 is rotably driven by an electric motor located in a casing 13.

By means of suitable tubing (not shown), water is caused to supply said tank or basin 2, having positioned therein the eggs to be sorted or selected, rainer 4, and rivulets for carrying the selected or sorted eggs to the outside.

The inclination of rebound wall 5, as well as the position of partition 14 can be adjusted.

A bulkhead or baffle plate 15, which at the bottom is separated from the bottom, causes the eggs to become thoroughly distributed for passing therebeneath in the transfer movement from tank or basin 2 to drum 3.

Due to drying suction, water entering said drum is re-used for transferring to the outside the selected or sorted eggs outcoming from conduits 8 and 9, respectively, or is directly exhausted to the outside by a free outlet to which it is caused to flow.

Drum 1 is pivoted on sides 16 and 17 and rotates about a tube 18, which is partly an intake or suction tube and partly a blowing tube.

Since the eggs become aligned on the drum in an accurate and constant number or amount, orderly moving to the selection or sorting step, one needs only to count the number of rows passed to such a selection or sorting step or the number of revolutions of said drum, respectively multiplied by a proper coefficient, to know with a good approximation the number of amount of selected or sorted eggs.

As a practical matter of fact, the provision and operation of a mechanical counter 19 or a photoelectric cell counter 20 will suffice for counting the selected or sorted eggs.

For a separate count of quality eggs, one needs to pass them again through the apparatus after the selection or sorting has been finished.

It is within the scope of the apparatus according to the invention also an embodiment for a separate counter.

What I claim is:

1. A sorting apparatus generally for trout and fish eggs of the type comprising an inclined wall, said wall providing a surface against which eggs are launched and caused to rebound therefrom according to different trajectories depending on the resilience of the eggs and spaced collecting means, for collecting the eggs according to their trajectories; wherein, said apparatus comprises a tank adapted to receive the eggs together with water, and a rotating drum associated to said tank and provided with a plurality of cups on the outer surface thereof, said cups being aligned in parallel rows extending along the drum generatrices and having a perforated bottom, each of said cups being designed to separately accommodate one egg therein so that, upon rotation of said drum, the eggs contained in the cups are removed from the water.

2. A sorting apparatus according to claim 1, wherein: means are provided adapted to cause an air flow through said perforated cups in order to dry the eggs in the cups by ventilation.

3. A sorting apparatus according to claim 1, wherein: said apparatus comprises a pneumatic launching device for launching the dried eggs against said inclined wall by blowing action exerted thereby through the cup holes.

4. A sorting apparatus according to claim 3, wherein: said inclined wall is located in front of the egg launching line and is perpendicular to the direction of the flow of blown air.

5. A sorting apparatus according to claim 1, wherein: said collecting means have a slanting bottom to allow water flowing therein to transfer the sorted eggs outside the sorting apparatus.

6. A sorting device according to claim 1, wherein: a counter is provided for counting the sorted eggs according to the rows of cups in the drum or the revolutions of the drum.

* * * * *